US009101025B2

(12) United States Patent
Lu et al.

(10) Patent No.: US 9,101,025 B2
(45) Date of Patent: Aug. 4, 2015

(54) SYSTEMS AND METHODS FOR DRIVING LIGHT EMITTING DIODES

(75) Inventors: Wei Lu, Saratoga, CA (US); Stephen Leeboon Wong, Saratoga, CA (US); William Mai, San Jose, CA (US); Tri Le, San Jose, CA (US)

(73) Assignee: MARVELL WORLD TRADE LTD., St. Michael (BB)

( * ) Notice: Subject to any disclaimer, the term of this patent is extended or adjusted under 35 U.S.C. 154(b) by 816 days.

(21) Appl. No.: 13/356,796

(22) Filed: Jan. 24, 2012

(65) Prior Publication Data

US 2012/0194087 A1 Aug. 2, 2012

Related U.S. Application Data

(60) Provisional application No. 61/437,978, filed on Jan. 31, 2011.

(51) Int. Cl.

| | |
|---|---|
| ***H05B 37/00*** | (2006.01) |
| ***H05B 39/00*** | (2006.01) |
| ***H05B 41/00*** | (2006.01) |
| ***H05B 33/08*** | (2006.01) |

(52) U.S. Cl.
CPC ..... *H05B 33/0851* (2013.01); *H05B 33/0815* (2013.01)

(58) Field of Classification Search
None
See application file for complete search history.

(56) References Cited

U.S. PATENT DOCUMENTS

| | | | | |
|---|---|---|---|---|
| 2004/0251854 | A1 | 12/2004 | Matsuda et al. | |
| 2005/0110469 | A1 * | 5/2005 | Inaba et al. | 323/222 |
| 2006/0279228 | A1 * | 12/2006 | Kato | 315/193 |
| 2009/0134817 | A1 * | 5/2009 | Jurngwirth et al. | 315/307 |
| 2010/0148681 | A1 | 6/2010 | Kuo et al. | |

OTHER PUBLICATIONS

International Preliminary Report on Patentability and Written Opinion dated Aug. 6, 2013 from related/corresponding International PCT Patent Appl No. PCT/US12/021796 filed Jan. 19, 2012.
International Search Report and Written Opinion of the International Searching Authority for Application PCT/US2012/022310 dated Nov. 20, 2012 (14 pages).

* cited by examiner

*Primary Examiner* — Jany Richardson

(57) ABSTRACT

System and methods are provided for driving one or more light emitting diodes (LEDs) to reduce audible noise. An example system includes a switching component, a system controller, and a current generator. The switching component is configured to receive a dimming signal with a predetermined dimming frequency and configured to switch on or off the one or more LEDs in response to the dimming signal, the predetermined dimming frequency being outside a frequency band of the audible noise. The system controller is configured to receive a feedback signal related to a LED current that flows through the one or more LEDs and configured to generate a drive signal. Additionally, the current generator is configured to receive the drive signal, to generate a charging current to store energy during a charging period and to generate the LED current during a discharging period.

10 Claims, 12 Drawing Sheets

SYSTEMS AND METHODS FOR DRIVING LIGHT EMITTING DIODES

CROSS-REFERENCE TO RELATED APPLICATIONS

This application claims priority to and benefit from U.S. Provisional Patent Application No. 61/437,978, filed on Jan. 31, 2011, and entitled "Method and Apparatus to Remove Audible Noise for boost Converter With WLED Driver," the entirety of which is incorporated herein by reference.

FIELD

The technology described in this patent document relates generally to driving light emitting diodes.

BACKGROUND

Light emitting diodes (LEDs) are widely used in portable devices (e.g., cell phones) for various applications. For example, white LEDs (WLEDs) are often used for backlighting liquid crystal display (LCD) screens and dimming keypads in portable devices. Under many circumstances, it is important to have uniform color/luminous intensity across an LCD screen. Because color and luminous intensity of an LED depend on an average current flowing through the LED, all LEDs used for backlighting the LCD screen usually need to have similar average currents to keep color/luminous uniformity.

There are many approaches for current matching of LEDs. For example, conventionally, multiple LED strings may be used in parallel, where each LED string is connected with a current sink. Current matching is achieved through trimming the current sinks. As another example, a power converter, e.g., a boost converter, can be used to drive multiple LED strings for current matching. A pulse-frequency-modulation (PFM) topology may be implemented in the power converter.

The PFM converter can operate with different switching frequencies depending on load conditions. For example, the switching frequency of the PFM converter is higher for a heavy load than that for a light load. One disadvantage of the PFM converter is that audible noise may be generated when the switching frequency is very low under a light-load/no-load condition. A pulse-width-modulation (PWM) topology, which often uses a fixed frequency, may be implemented in the power converter to reduce audible noise. However, it too has a number of disadvantages. Efficiency of a PWM converter, for example, is often much lower than that of the PFM converter. Also, the PWM converter usually needs bulky external components which are not suitable for portable devices. In addition, when a power converter is used to drive multiple LED strings, audible noise may be generated from voltage ripples when the LED strings need different output voltages and have different duty cycles.

An improved method to drive LEDs using a power converter (e.g., a PFM power converter) with reduced audible noise is highly desirable.

SUMMARY

In accordance with the teachings described herein, systems and methods are provided for one or more light emitting diodes (LEDs) to reduce audible noise. In one embodiment, a system includes a first switching component, a system controller, and a current generator. A first switching component is configured to receive a dimming signal with a predetermined dimming frequency and configured to switch on or off one or more LEDs in response to the dimming signal, the predetermined dimming frequency being higher than the frequency band of the audible noise. The system controller is configured to receive a feedback signal related to a LED current that flows through the one or more LEDs and configured to generate a drive signal. Additionally, the current generator is configured to receive the drive signal, to generate a charging current to store energy during a charging period and to generate the LED current during a discharging period, the charging period and the discharge period being both within a dimming period corresponding to the predetermined dimming frequency.

In another embodiment, a system for driving strings of light emitting diodes (LEDs) includes a dimming controller, a first switching component, a second switching component, and a detection circuit. The dimming controller is configured to generate a first dimming signal with a first dimming frequency and a second dimming signal with a second dimming frequency. The first switching component is configured to receive the first dimming signal and configured to switch on or off a first LED string in response to the first dimming signal, the first LED string having a first voltage drop when being switched on. The second switching component is configured to receive the second dimming signal and configured to switch on or off a second LED string in response to the second dimming signal, the second LED string being coupled in parallel with the first LED string and having a second voltage drop when being switched on. The detection circuit is configured to receive a first feedback signal related to the first voltage drop and a second feedback signal related to the second voltage drop, and configured to generate a first detection signal indicating whether the first voltage drop is larger than the second voltage drop in magnitude. When the first voltage drop is larger than the second voltage drop in magnitude, the dimming controller is further configured to change the first dimming signal and the second dimming signal to keep the first LED string on when the second LED string is on. When the first voltage drop is smaller than the second voltage drop in magnitude, the dimming controller is further configured to change the first dimming signal and the second dimming signal to keep the second LED string on when the first LED string is on.

In yet another embodiment, a method is provided for driving one or more light emitting diodes (LEDs) to reduce audible noise. For example, a dimming signal with a predetermined dimming frequency is received. The one or more LEDs is switched on or off in response to the dimming signal, the predetermined dimming frequency being higher than a frequency band of the audible noise. A feedback signal related to a LED current that flows through the one or more LEDs is received. A charging current is generated to store energy during a charging period and the LED current during a discharging period, the charging period and the discharge period being both within a dimming period corresponding to the predetermined dimming frequency.

In yet another embodiment, a method is provided for driving one or more light emitting diodes (LEDs) to reduce audible noise is provided. For example, a first dimming signal with a first dimming frequency is received. A first LED string is switched on or off in response to the first dimming signal, the first LED string having a first voltage drop when being switched on. A second dimming signal with a second dimming frequency is received. A second LED string is switched on or off in response to the second dimming signal, the second LED string being coupled in parallel with the first LED string and having a second voltage drop when being switched on. A first feedback signal related to the first voltage drop and a second feedback signal related to the second voltage drop are received. A detection signal indicating whether the first voltage drop is larger than the second voltage drop in magnitude is generated. When the first voltage drop is larger than the second voltage drop in magnitude, the first dimming signal and the second dimming signal are changed to keep the first LED string on when the second LED string is on. When the first voltage drop is smaller than the second voltage drop in magnitude, the first dimming signal and the second dimming signal are changed to keep the second LED string on when the first LED string is on.

DETAILED DESCRIPTION

Audible noise often results from a low switching frequency of a pulse-frequency-modulation (PFM) power converter under a light-load/no-load condition. Thus, if the switching frequency of the PFM power converter is kept higher than an audible frequency range (e.g., 20 Hz-20 kHz), the audible noise can be reduced.

Figure 1:
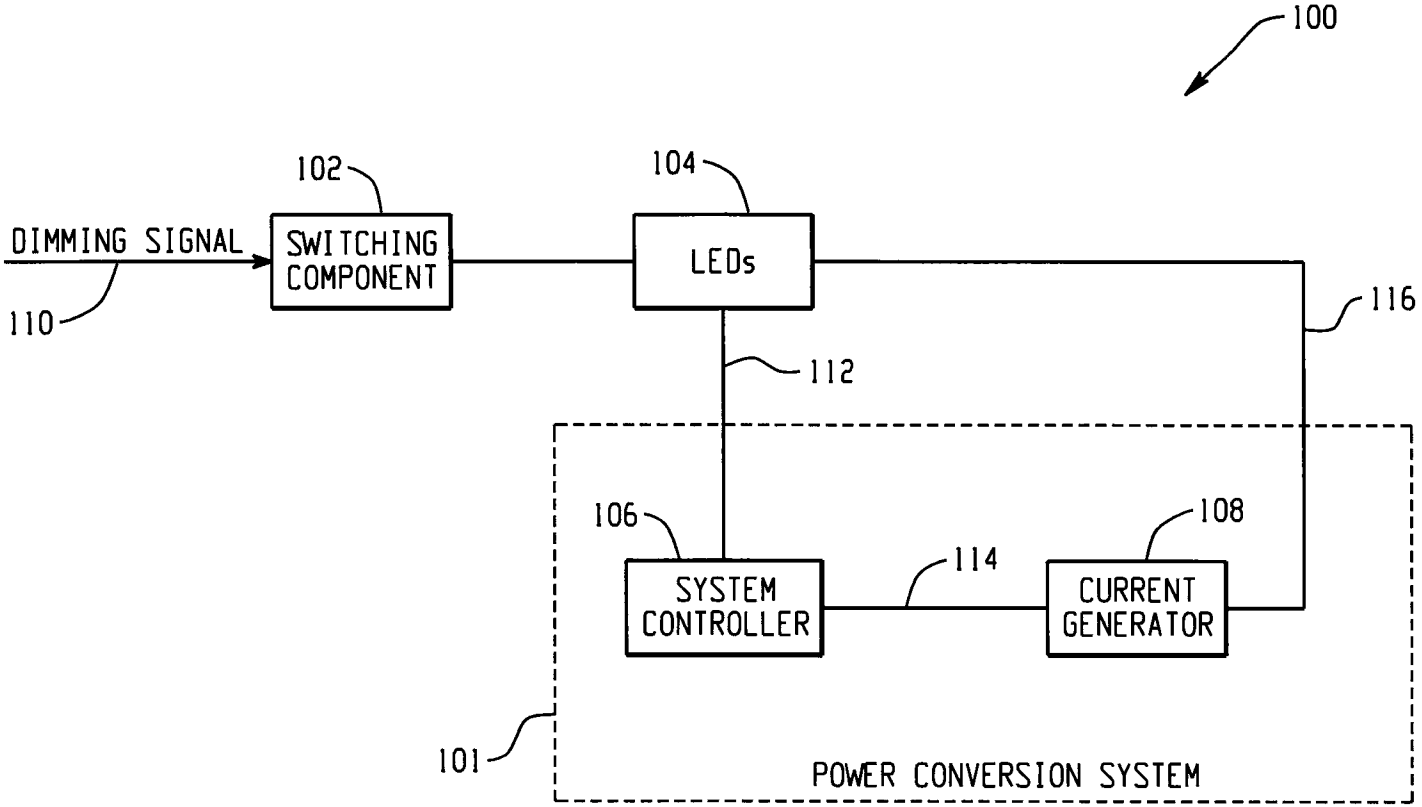
FIG. 1 illustrates an example system for driving one or more LEDs using a power conversion system.

FIG. 1 illustrates an example system 100 for driving one or more LEDs using a power conversion system. A power conversion system 101 is used to drive one or more LEDs 104. A switching component 102 switches on or off the LEDs 104 in response to a dimming signal 110. The dimming signal 110 has a predetermined dimming frequency that is higher than the audible frequency range (e.g., 20 Hz-20 kHz). A switching frequency of the power conversion system 101 is kept at least at the predetermined dimming frequency to reduce the audible noise.

Specifically, the power conversion system 101 includes a system controller 106 and a current generator 108. The system controller 106 receives a feedback signal 112 that is related to a current 116 that flows through the LEDs 104 and outputs a drive signal 114 to the current generator 108. A switching period that corresponds to the switching frequency of the power conversion system 101 includes a charging period and a discharging period. The current generator 108 generates a charging current to store energy during the charging period and outputs the current 116 that flows through the LEDs 104 during the discharging period. To keep the switching frequency of the power conversion system 101 at least at the predetermined dimming frequency, the power conversion system 101 switches at least once in each dimming period corresponding to the predetermined dimming frequency. For example, the current generator 108 generates a charging current and outputs the current that flows through the LEDs 104 at least once during each dimming period.

Figure 2:
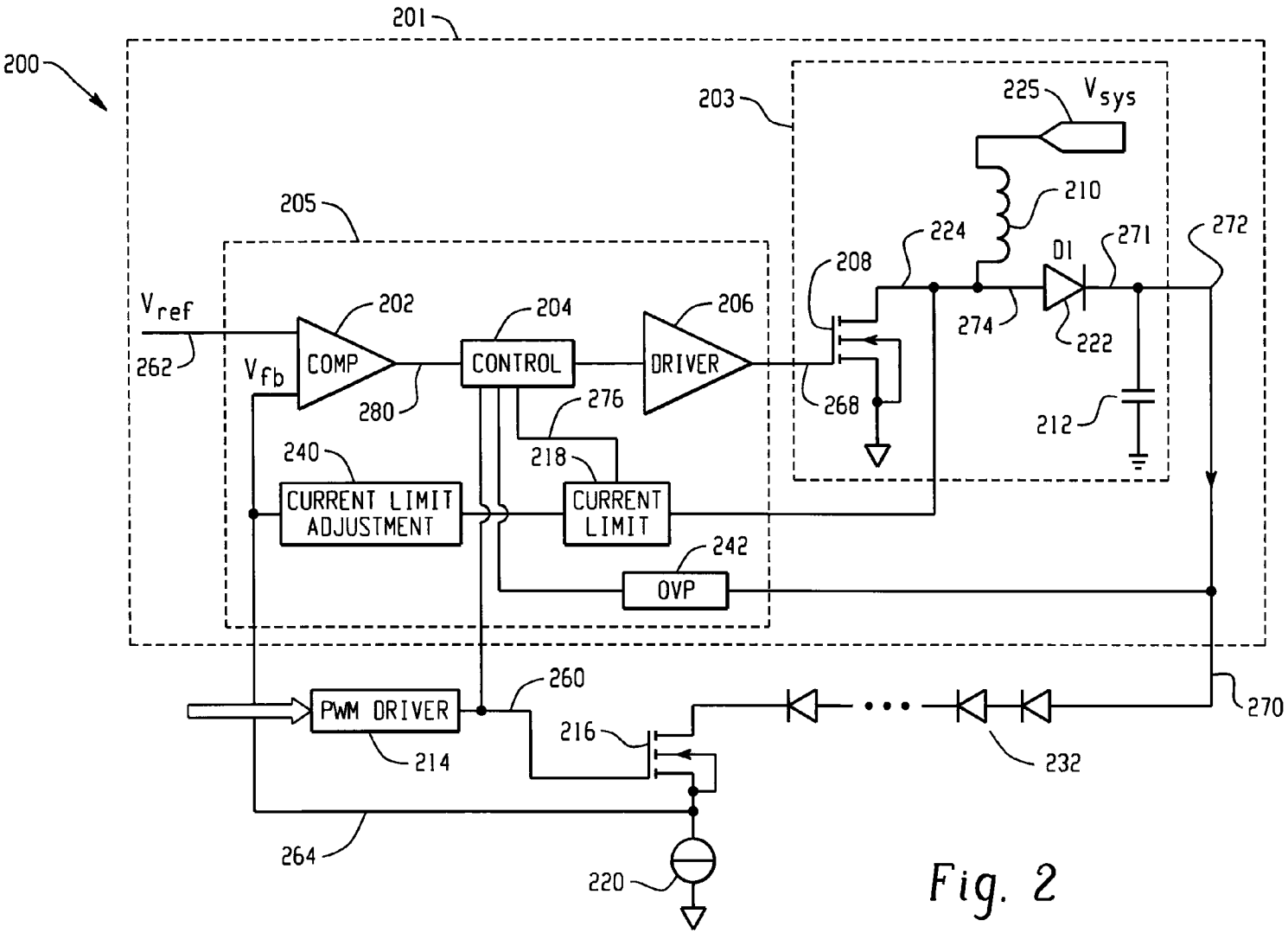
FIG. 2 illustrates an example system for driving one or more LEDs to reduce audible noise.

FIG. 2 illustrates an example system 200 for driving one or more LEDs to reduce audible noise. A dimming controller 214 (e.g., a PWM driver) outputs a dimming signal 260 that has a dimming frequency (e.g., 32 kHz) higher than the audible frequency band (e.g., 20 Hz-20 kHz). A switch 216 (e.g., a transistor) switches on or off one or more LEDs 232 in response to the dimming signal 260. A power conversion system 201, including a current generator 203 and a system controller 205, receives a feedback signal 264 and generates a current 270 that flows through the LEDs 232. The switching frequency of the power conversion system 201 is kept at least at the dimming frequency, and thus the audible noise can be reduced.

Specifically, the system controller 205 includes a comparator 202, and a gate-driving component 206, and the current generator 203 includes a switch 208 (e.g., a transistor), an inductor 210, a capacitor 212, and a diode 222. In operation, a current sink 220 outputs the feedback signal 264 related to the current 270 to the comparator 202 which compares the feedback signal 264 with a reference signal 262 and outputs a signal 280. Based on the comparison, a drive signal 268 is output from the gate-driving component 206 to turn on or off the switch 208.

The switch 208 may, for example, be a N-channel transistor with a drain terminal coupled to a node 274 and a source terminal connected to the ground. One terminal of the inductor 210 is coupled to the node 274, and the other terminal is biased to a system voltage 225 (e.g., 3-4 V). An anode terminal of the diode 222 is coupled to the node 274.

In one embodiment, when the switch 208 is turned on, a charging period starts. The voltage of the node 274 is pulled to ground, and the diode 222 is reverse-biased. A charging current 224 is generated flowing from the inductor 210 through the switch 208, and energy is stored in the inductor 210. The capacitor 212 discharges to provide an output voltage 272 for the LEDs 232. When the switch 208 is turned off, a discharging period starts. The inductor 210 resists the current change by increasing the voltage of node 274. Then, the diode 222 is forward-biased. A current 271 is generated flowing from the inductor 210 through the diode 222, and the capacitor 212 is charged during the discharging period. For example, the current 271 is larger than the current 270 in magnitude.

The system controller 205 may further include a current-limit component 218 that monitors the charging current 224. If the charging current is larger than a particular current limit in magnitude, the current-limit component 218 outputs a signal 276 to a control component 204 to turn off the switch 208.

The system controller 205 may additionally include a current-limit-adjustment component 240 to adjust the current limit used by the current-limit component 218. For example, the switching frequency of the power conversion system 201 is proportional to a product of the current 270 and an output voltage 272. Because the switching frequency of the power conversion system 201 is kept above a minimum frequency to reduce audible noise, the output voltage 272 may become very high when the current 270 is very low under the light-load/no-load condition. The current-limit-adjustment component 240 may decrease the current limit used by the current-limit component 218, so that less energy is stored in the inductor 210 during the charging period and in turn the capacitor 212 is charged less during the discharging period. Eventually, the output voltage 272 is lowered. On the other hand, if the output voltage 272 is lower than a threshold, the current-limit-adjustment component 240 may increase the current limit used by the current-limit component 218, so that a maximum switching frequency can be maintained. For example, the current-limit-adjustment component 240 may include one or more comparators to compare the feedback signal 264 with reference voltages. As another example, the current-limit-adjustment component 240 may additionally include a digital filter. The current-limit adjustment may be implemented manually with fully programmable parameters or be implemented automatically.

The power conversion system 201 may include other system protection mechanisms, such as over-voltage protection, and over-temperature protection. For example, an over-voltage protector 242 may be implemented to monitor the output voltage 272 and outputs a signal 277 to the control component 204 to turn off the power conversion system 201 if the output voltage 272 exceeds a threshold.

To keep the switching frequency of the power conversion system 201 at least at the dimming frequency, the switch 208 may be forced to switch on at least once during each dimming period corresponding to the dimming frequency. In one embodiment, the signal 280 generated by the comparator 202 is set to a particular logic level (e.g., a logic high level) at the beginning of a dimming period to ensure that the switch 208 is turned on at least once during the dimming period. In another embodiment, the control component 204 implements an OR gate to force the switch 208 to turn on at least once during a dimming period, as shown in FIG. 3.

Figure 3:
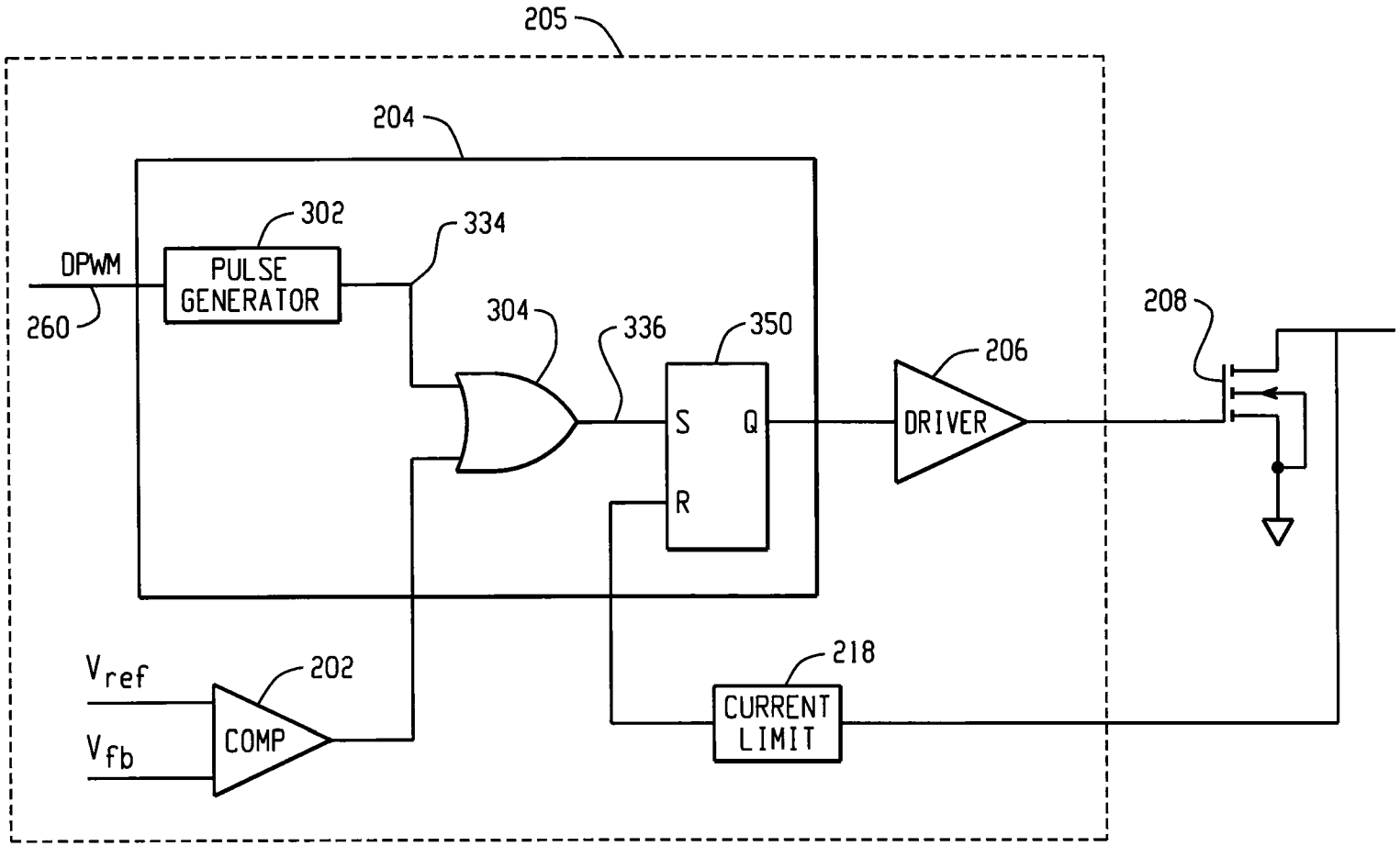
FIG. 3 illustrates an example diagram of the system controller of FIG. 2 to turn on the switch at least once during a dimming period.

FIG. 3 illustrates an example diagram of the system controller 205 of FIG. 2 to turn on the switch 208 at least once during a dimming period. As shown in FIG. 3, the control component 204 includes a pulse generator 302, an OR gate 304 and a flip flop 350. The pulse generator 302 receives the dimming signal 260 and outputs a pulse signal 334 to the OR gate 304, for example, at the beginning of a dimming period. The pulse signal 334 may have a short pulse width (e.g., 100 ns). The OR gate 304 may output a signal 336 at a logic high level during a pulse width of the pulse signal 334, regardless of the outcome of the comparator 202. In turn, the drive signal 268 is generated to turn on the switch 208 during the pulse width of the pulse signal 334.

Figure 4:
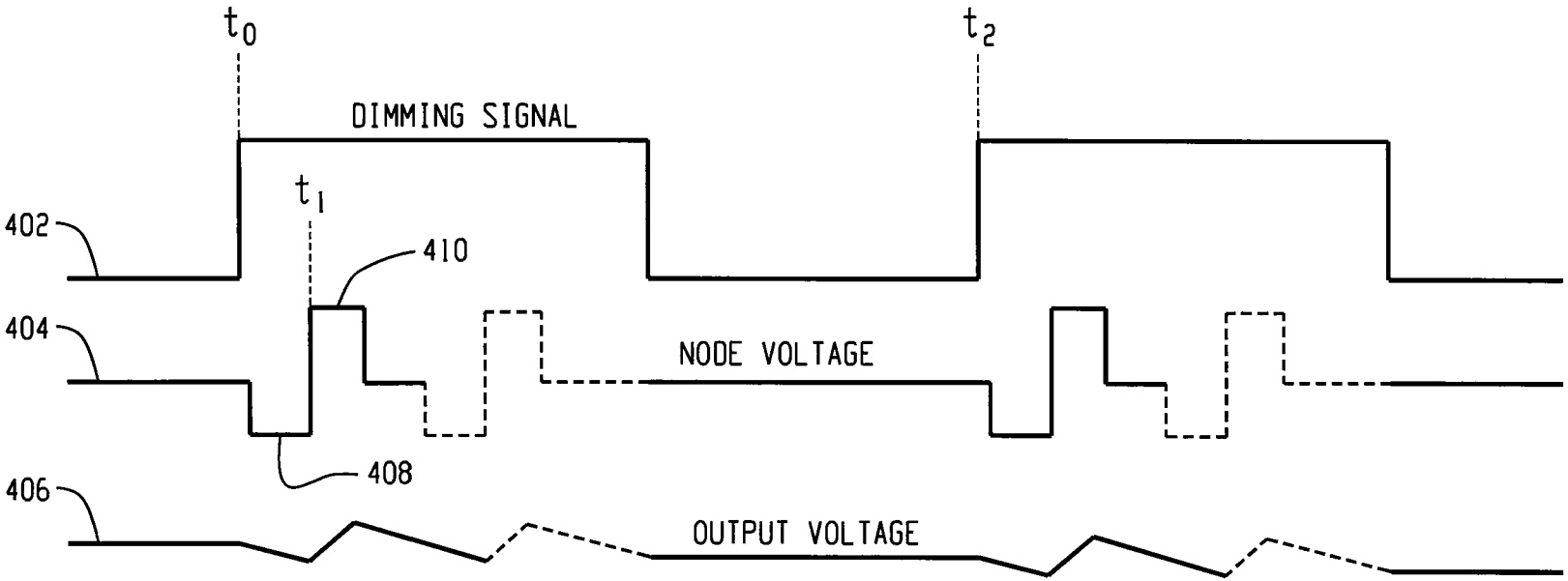
FIG. 4 depicts a timing diagram illustrating an example operation of the system of FIG. 2.

FIG. 4 depicts a timing diagram illustrating an example operation of the system 200 of FIG. 2. The waveform 402 represents the dimming signal 260 (FIG. 2) as a function of time. The waveform 404 represents the voltage of node 274 (FIG. 2) as a function of time. Additionally, the waveform 406 represents the output voltage 272 (FIG. 2) as a function of time. As shown in FIG. 4, during each dimming period between timing reference points $t_0$ and $t_2$, the voltage of the node 274 changes, at least once, to a low voltage 408 (e.g., the ground voltage), which indicates the switch 208 is turned on at least once. The output voltage 272 decreases in magnitude when the voltage of node 274 is at the low voltage 408, which indicates that the capacitor 212 discharges.

Specifically, the timing diagram of FIG. 4 shows that the dimming signal 260 is at a logic high level that indicates the LEDs 232 are switched on at the timing reference point $t_0$. Then, the switch 208 is turned on (e.g., by a pulse signal as shown in FIG. 3), and the voltage of the node 274 is pulled to the ground voltage 408. The output voltage 272 decreases in magnitude as the capacitor 212 discharges. The feedback signal 264, which is related to the output voltage 272, also decreases in magnitude. At a subsequent timing reference point $t_1$, the charging current 224 is higher than a particular current limit in magnitude. Then, the switch 208 is turned off, and the voltage of the node 274 increases to a particular value 410 as the inductor resists the current change. The current 271 flows from the inductor 210 through the diode 222 and charges the capacitor 212, and thus the output voltage 272 increases in magnitude. Subsequently, the current 271 decreases in magnitude. When the current 271 reduces to zero, the capacitor 212 begins to discharge and the output voltage 272 drops. In turn, the feedback signal 264 decreases in magnitude. When the feedback signal 264 becomes less than the reference signal 262 in magnitude, the comparator 202 changes the signal 280 and the switch 208 is turned on. A new charging/discharging cycle starts. The switch 208 may be turned on and off multiple times during a dimming period. In any event, the switching frequency of the power conversion system 201 is at least at the dimming frequency which is higher than the audible frequency range (e.g., 20 Hz-20 kHz).

Multiple LED strings, which each include one or more LEDs, are often used in portable devices. The power conversion system 201 may be used to drive multiple LED strings which are connected in parallel, where different dimming signals may be used for switching on or off the LED strings, respectively. Audible noise, however, may be generated from output voltage ripples on the capacitor 212, i.e., time-varying components of the output voltage.

Figure 5:
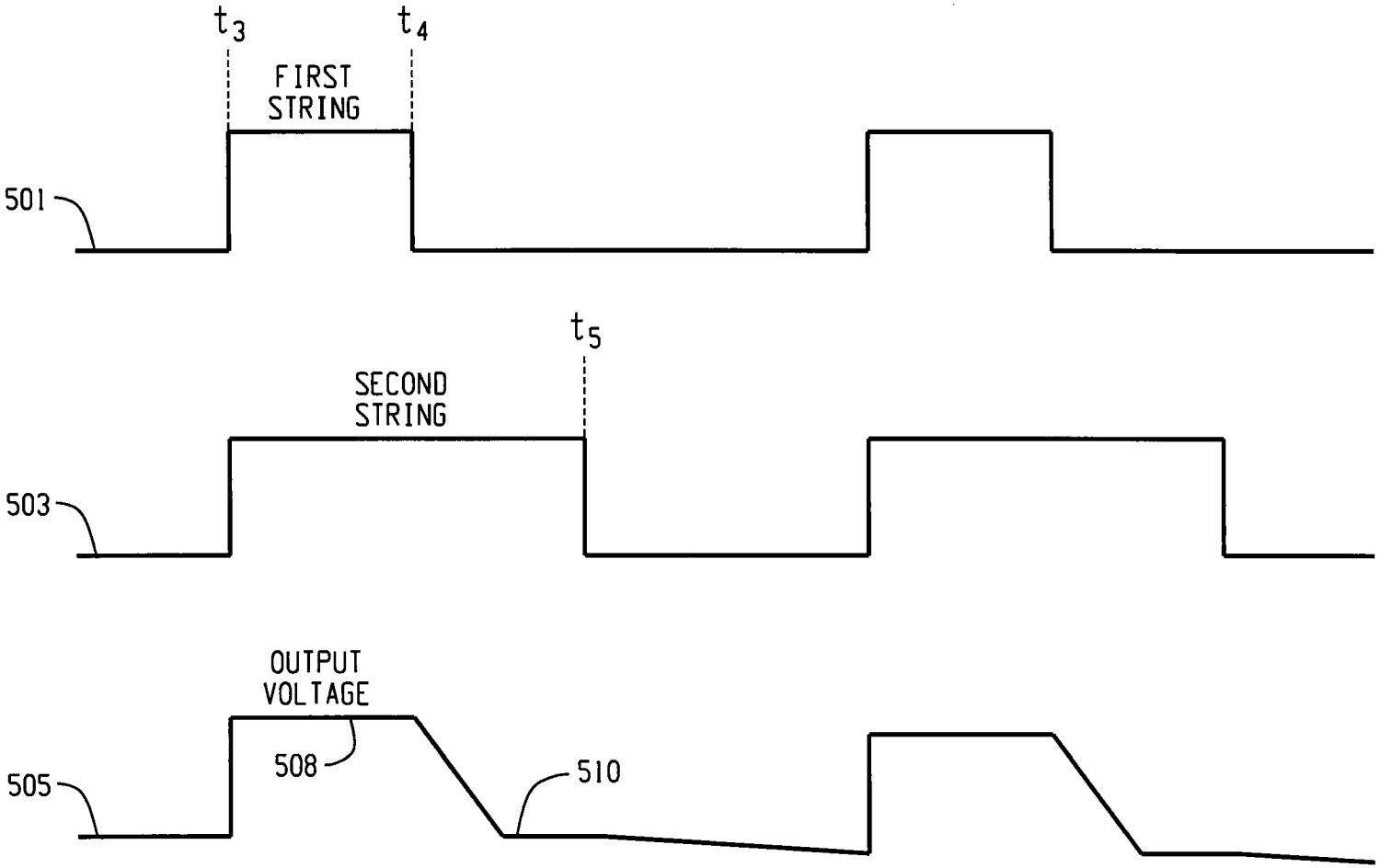
FIG. 5 depicts a timing diagram illustrating an example operation of driving LED strings using the power conversion system of FIG. 2.

FIG. 5 depicts a timing diagram illustrating an example operation of driving LED strings using the power conversion system 201 of FIG. 2. The waveform 501 represents a first dimming signal for a first LED string as a function of time. The waveform 503 represents a second dimming signal for a second LED string as a function of time. Additionally, the waveform 505 represents the output voltage 272 (FIG. 2) as a function of time.

Different LED strings may have different voltage drops when being turned on, and the output voltage 272 may change when different LED strings are turned off at different times during a same dimming period. As shown in FIG. 5, a first LED string and a second LED string are both switched on at a same timing reference point $t_3$. For example, the first LED string has a larger voltage drop than the second LED string. The output voltage 272 is at a value 508 which is sufficiently high for both LED strings. The first LED string is switched off at a timing reference point $t_4$, while the second LED string is switched off at a subsequent timing reference point $t_5$. At $t_4$, the output voltage 272 is sufficiently high to keep the second LED string on. The system controller 205 does not start a new charging/discharging cycle. Thereafter, the output voltage 272 decreases from the value 508 (e.g., at $t_4$) to a value 510 which is barely enough to keep the second LED string on. The system controller 205 then starts a new charging/discharging cycle to regulate the output voltage 272. Because the first LED string has a larger voltage drop than the second LED string, the output voltage change from the value 508 to a value 510 is often large enough to cause capacitor hamming noise.

Figure 6:
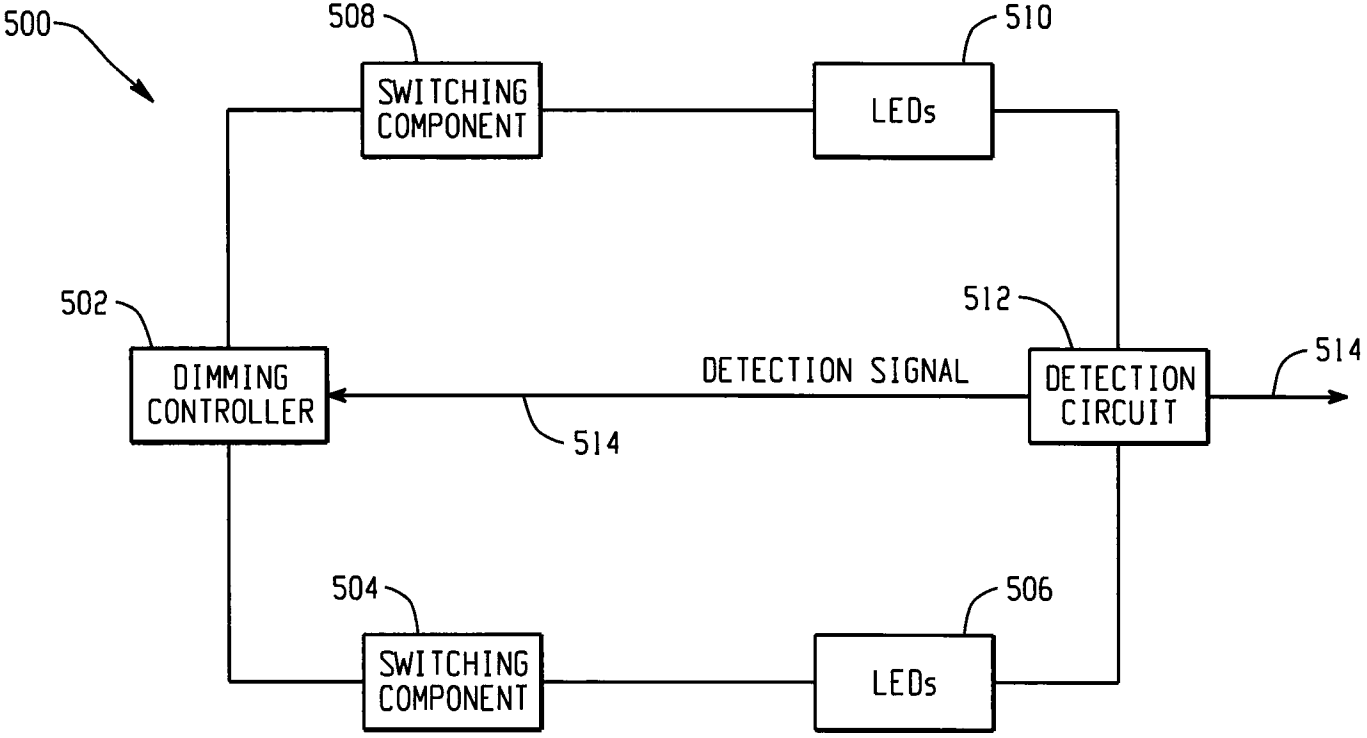
FIG. 6 illustrates an example system for driving LED strings using a detection circuit.
Figure 7A:
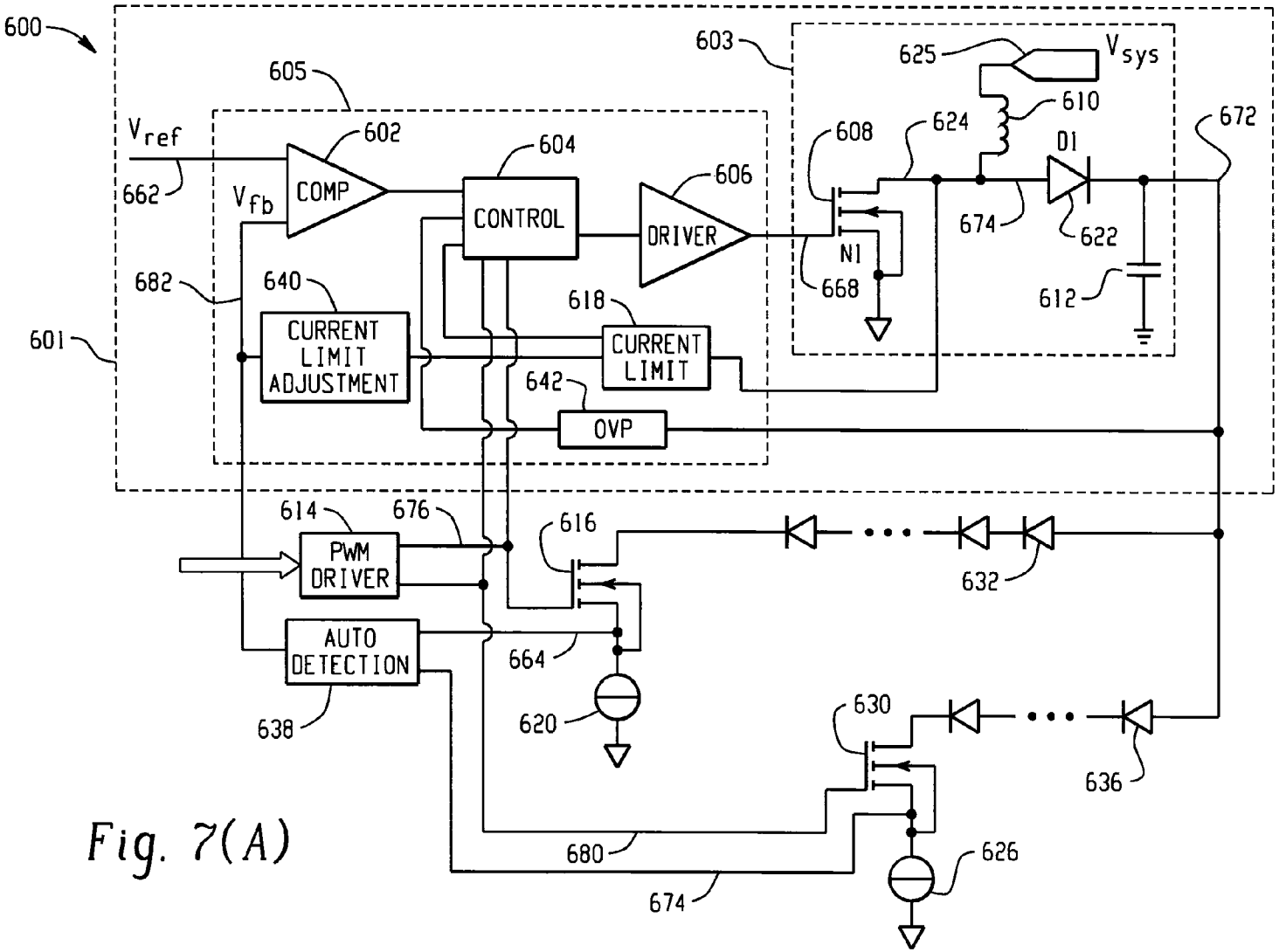
FIG. 7(A) illustrates an example system for driving two LED strings to reduce output voltage ripples.
Figure 8:
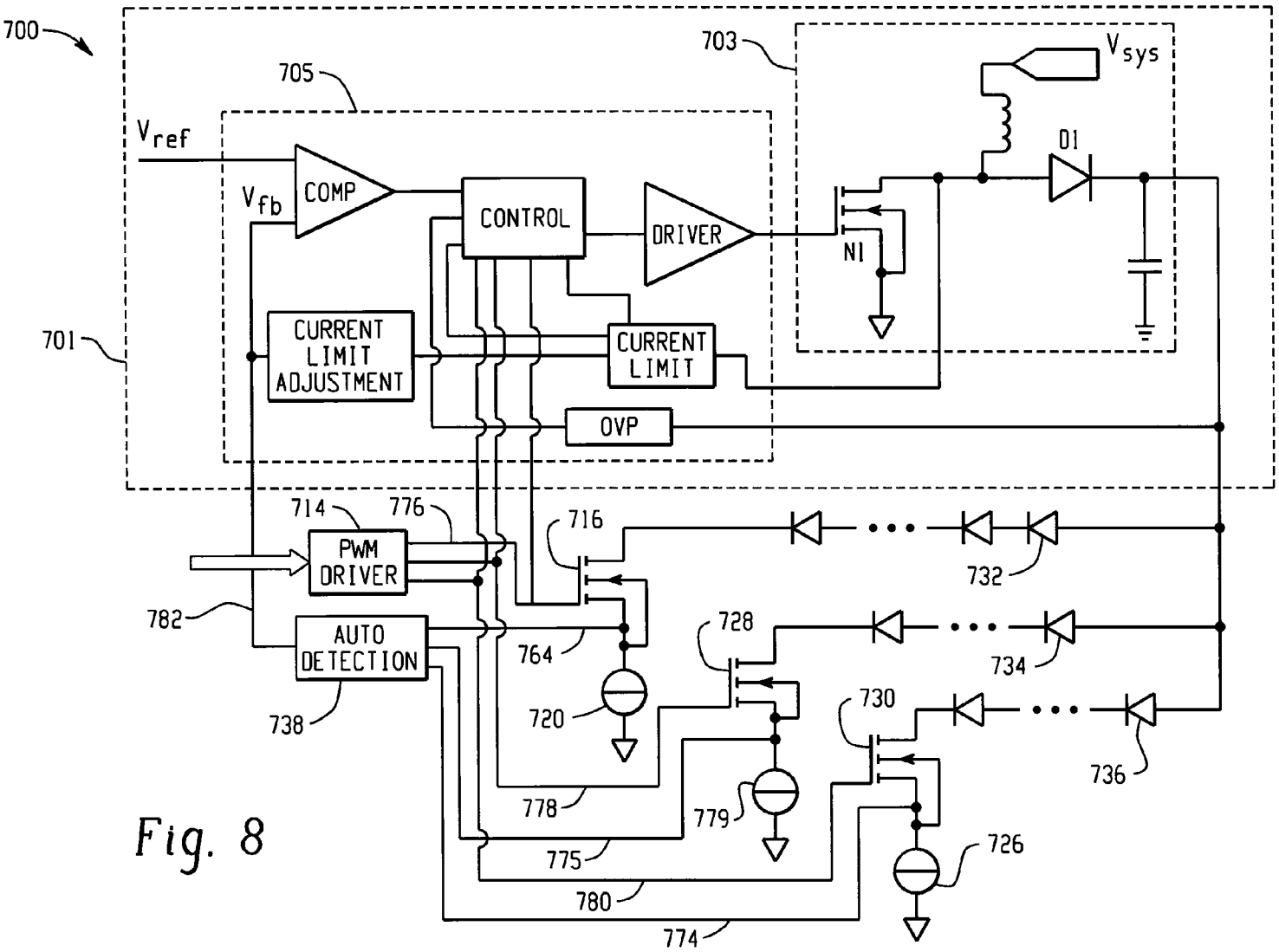
FIG. 8 illustrates an example system for driving more than two LED strings to reduce output voltage ripples.

An automatic-detection scheme can be used for driving LED strings to reduce output voltage ripples. FIG. 6 illustrates an example system 500 for driving LED strings using a detection circuit. Switching components 504 and 508 switch on or off LED strings 506 and 510, respectively, in response to dimming signals generated from a dimming controller 502. A detection circuit 512 receives feedback signals from the LED strings 506 and 510, and generates a detection signal 514 that indicates which LED string has a larger voltage drop. The dimming controller 502 changes the dimming signals to keep the LED string that has the larger voltage drop on when the other LED string is on in order to reduce output voltage ripples. Two LED strings are shown in FIG. 6 as an example, but more than two LED strings can be similarly driven using the detection circuit. FIG. 7(A) and FIG. 8 show two embodiments where multiple LED strings are driven using the automatic-detection scheme illustrated in FIG. 6.

FIG. 7(A) illustrates an example system 600 for driving two LED strings to reduce output voltage ripples. A dimming controller 614 outputs dimming signals to switches 616 and 630 which switch on or off LED strings 632 and 636, respectively. A detection component 638 receives feedback signals 664 and 674 which are related to voltage drops on the LED string 632 and the LED string 636, respectively. The detection component 638 outputs a detection signal 682 that indicates, when both the LED string 632 and the LED string 636 are turned on, which feedback signal is lower in magnitude and thus which LED string has a larger voltage drop. The dimming controller 614 reconfigures the dimming signals to keep the LED string that has a larger voltage drop on when the other LED string is on.

A power conversion system 601, including a current generator 603 and a system controller 605, receives the detection signal 682 and generates an output voltage 672 to drive the LED strings 632 and 636. In one embodiment, as shown in FIG. 7(A), the power conversion system 601 has a similar structure and operates similarly as the power conversion system 201 of FIG. 2.

In operation, the dimming controller 614 outputs the dimming signals 676 and 680 to the switches 616 and 630, respectively. For example, the dimming signals 676 and 680 have a same dimming frequency which may be higher than the audible frequency range. Current sinks 620 and 626 output the feedback signals 664 and 674 respectively to the detection component 638. The detection component 638 determines, based on the feedback signals 664 and 674, which LED string has a larger voltage drop. For example, if the LED string 632 has a larger voltage drop than the LED strings 636, the dimming controller 614 reconfigures the dimming signals 676 and 680 to keep the LED string 632 on whenever the LED string 636 is on. Thus, when the LED string 636 is turned off, the output voltage 672 of the power conversion system 601 is still regulated to drive the LED string 632. The output voltage ripple can be reduced to ameliorate the capacitor hamming noise.

Figure 7B:
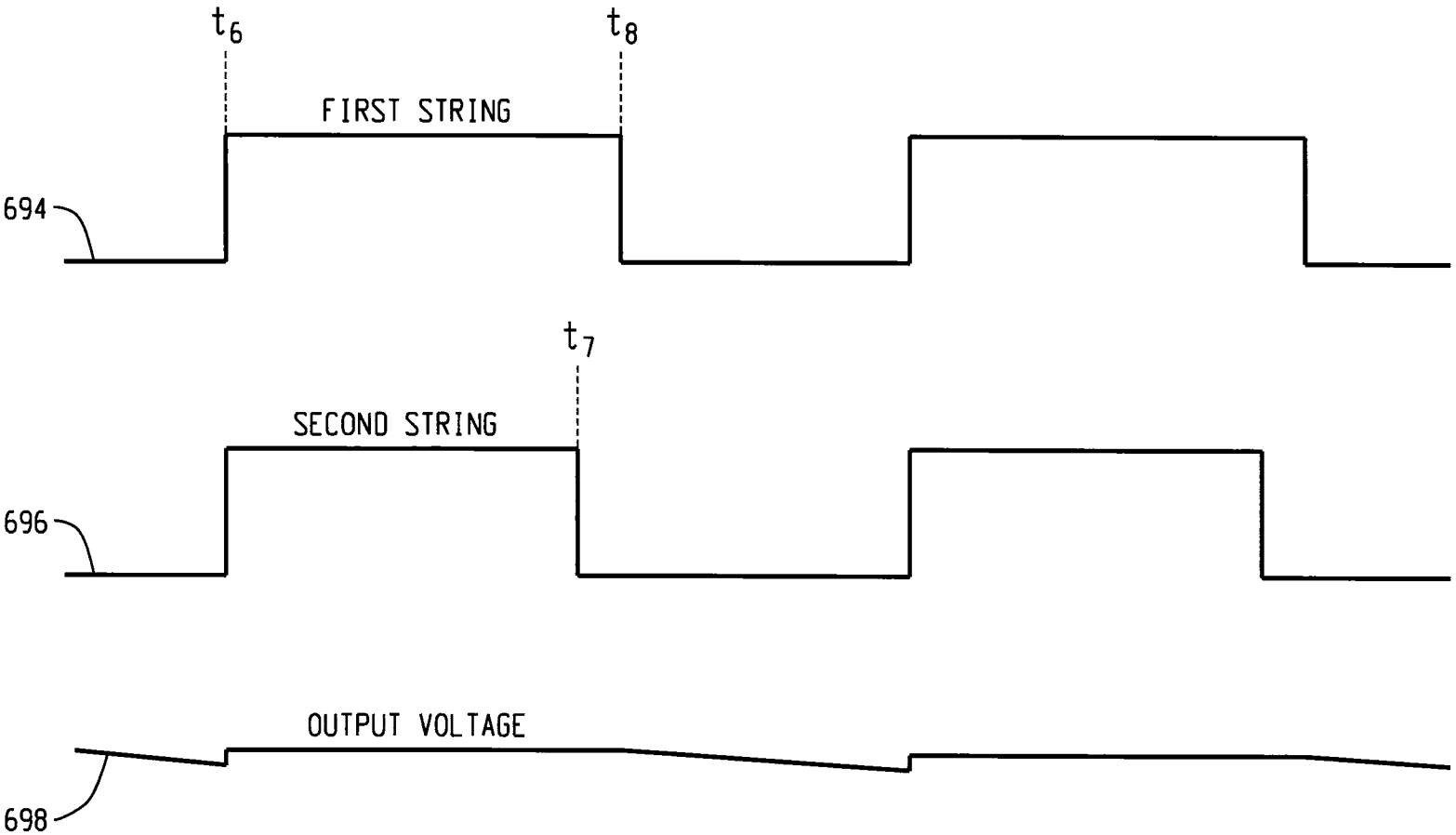
FIG. 7(B) depicts a timing diagram illustrating an example operation of the system of FIG. 7(A).

FIG. 7(B) depicts a timing diagram illustrating an example operation of the system 600 of FIG. 7(A). The waveform 694 represents the dimming signal 676 (FIG. 7(A)) for the LED string 632 (FIG. 7(A)) as a function of time. The waveform 696 represents the dimming signal 680 (FIG. 7(A)) for the LED string 636 (FIG. 7(A)) as a function of time. Additionally, the waveform 698 represents the output voltage 672 (FIG. 7(A)) as a function of time.

For example, the LED string 632 has a larger voltage drop when being turned on than the LED string 636. As shown in FIG. 7(B), the LED string 632 and the LED string 636 are both switched on at a same timing reference point $t_6$ during a dimming period. The output voltage 672 is sufficiently high for both the LED string 632 and the LED string 636. The LED string 636, however, is switched off at a timing reference point $t_7$, while the LED string 632 is turned off at a subsequent timing reference point $t_8$. At $t_7$, the output voltage 672 does not change much in magnitude because the LED string 632 that has the larger voltage drop is still on. Compared with FIG. 5, the voltage ripple has been reduced to ameliorate the capacitor hamming noise.

FIG. 8 illustrates an example system 700 for driving more than two LED strings to reduce output voltage ripples. A dimming controller 714 outputs dimming signals to switches 716, 728 and 730 which switch on or off LED strings 732, 734 and 736, respectively. A detection component 738 receives feedback signals 764, 775 and 774 which are related to voltage drops on the LED string 732, the LED string 734 and the LED string 736, respectively. The detection component 738 outputs a detection signal 782 that indicates, when three LED strings are all turned on, which feedback signal is lowest in magnitude and thus which LED string has a largest voltage drop. The dimming controller 714 reconfigures the dimming signals to keep the LED string with a largest voltage drop on when either of the other two LED strings is on.

A power conversion system 701, including a current generator 703 and a system controller 705, receives the detection signal 782 and generates an output voltage 772 to drive the LED strings 732, 734 and 736. In one embodiment, as shown in FIG. 8, the power conversion system 701 has a similar structure and operates similarly as the power conversion system 201 of FIG. 2.

In operation, the dimming controller 714 outputs the dimming signals 776, 778 and 780 to the switches 716, 728 and 730, respectively. Current sinks 720, 779 and 726 output the feedback signals 764, 775 and 774 respectively to the detection component 738. The detection component 738 determines, based on the feedback signals 764, 775 and 774, which LED string has a largest voltage drop. For example, if the LED string 732 has a larger voltage drop than the LED strings 734 and 736, the dimming controller 714 reconfigures the dimming signal 776, 778 and 780 to keep the LED string 732 on whenever either the LED string 734 or the LED string 736 is on. Thus, when either the LED string 734 or the LED string 736 is turned off, the output voltage 772 of the power conversion system 701 is still regulated to drive the LED string 732. Then the output voltage ripple can be reduced to ameliorate the capacitor hamming noise.

Figure 9:
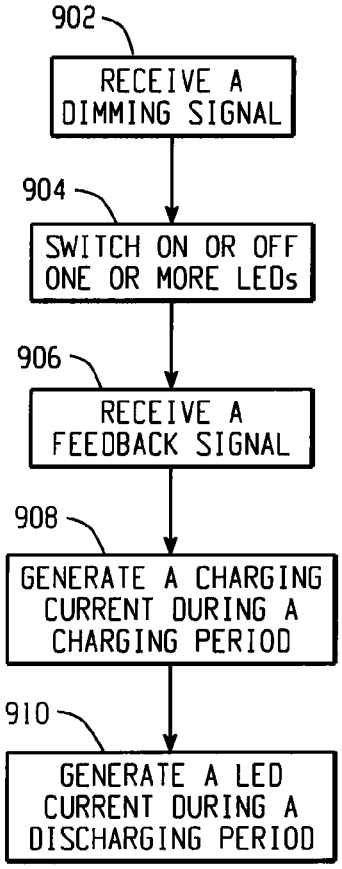
FIG. 9 illustrates an example flow diagram depicting a method for driving one or more LEDs to reduce audible noise.

FIG. 9 illustrates an example flow diagram depicting a method for driving one or more LEDs to reduce audible noise. At 902, a dimming signal with a predetermined dimming frequency is received. The one or more LEDs are switched on or off in response to the dimming signal at 904. The predetermined dimming frequency is higher than a frequency band of the audible noise. A feedback signal related to a LED current that flows through the one or more LEDs is received at 906. A charging current is generated to store energy during a charging period at 908, and the LED current is generated during a discharging period at 910. The charging period and the discharge period are both within a dimming period corresponding to the predetermined dimming frequency. For example, a dimming period includes more than one charging period or more than one discharging period.

Figure 10:
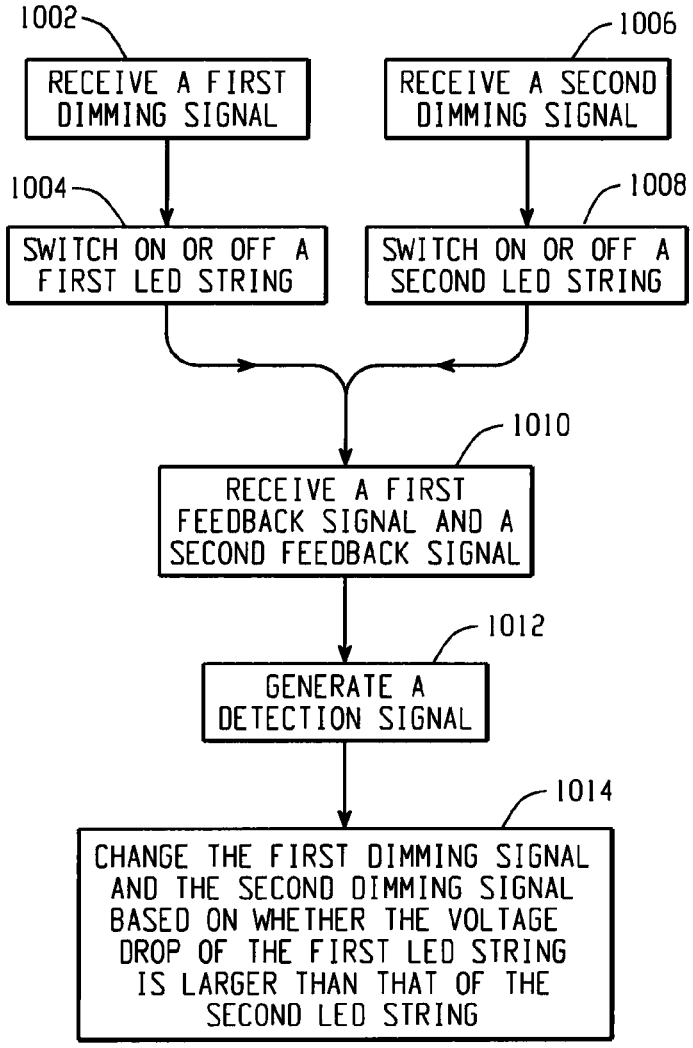
FIG. 10 illustrates an example flow diagram depicting a method for driving strings of LEDs.

FIG. 10 illustrates an example flow diagram depicting a method for driving strings of LEDs. A first dimming signal with a first dimming frequency is received at 1002. A first LED string is switched on or off in response to the first dimming signal at 1004. The first LED string has a first voltage drop when being switched on. At 1006, a second dimming signal with a second dimming frequency is received. A second LED string is switched on or off in response to the second dimming signal at 1008. The second LED string is coupled in parallel with the first LED string and having a second voltage drop when being switched on. A first feedback signal related to the first voltage drop and a second feedback signal related to the second voltage drop are received at 1010. A detection signal indicating whether the first voltage drop is larger than the second voltage drop in magnitude is generated at 1012. At 1014, the first dimming signal and the second dimming signal are changed based on whether the first voltage drop is larger than the second voltage drop in magnitude. For example, when the first voltage drop is larger than the second voltage drop in magnitude, the first dimming signal and the second dimming signal are changed to keep the first LED string on when the second LED string is on. When the first voltage drop is smaller than the second voltage drop in magnitude, the first dimming signal and the second dimming signal are changed to keep the second LED string on when the first LED string is on.

Figure 11:
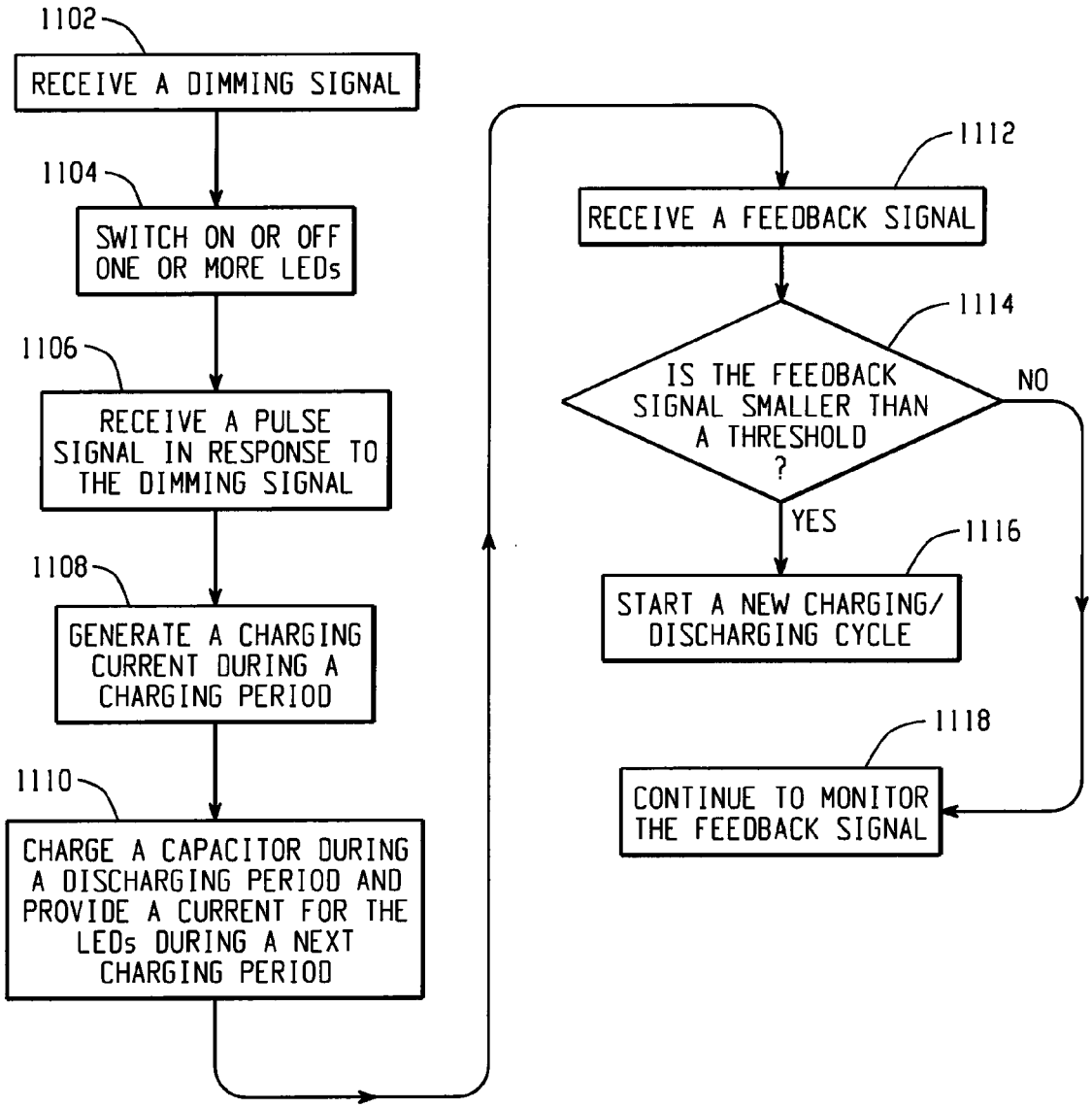
FIG. 11 illustrates another example flow diagram depicting a method for driving one or more LEDs to reduce audible noise.

FIG. 11 illustrates another example flow diagram depicting a method for driving one or more LEDs to reduce audible noise. At 1102, a dimming signal with a predetermined dimming frequency is received. The one or more LEDs are switched on or off in response to the dimming signal at 1104. The predetermined dimming frequency is higher than a frequency band of the audible noise. At 1106, a pulse signal is received in response to the dimming signal to ensure that a switch is turned on at least once during a dimming period associated with the dimming frequency. At 1108, a charging current is generated during a charging period when the switch is turned on. A capacitor is charged during a discharging period, and provides a current for the LEDs during a next charging period at 1110. A feedback signal related to a LED current that flows through the one or more LEDs is received at 1112. It is determined whether the feedback signal is smaller than a threshold in magnitude at 1114. If the feedback signal is smaller than the threshold in magnitude, a new charging/discharging cycle is started at 1116. If the feedback signal is not smaller than the threshold in magnitude, the feedback signal continues to be monitored at 1118.

Figure 12:
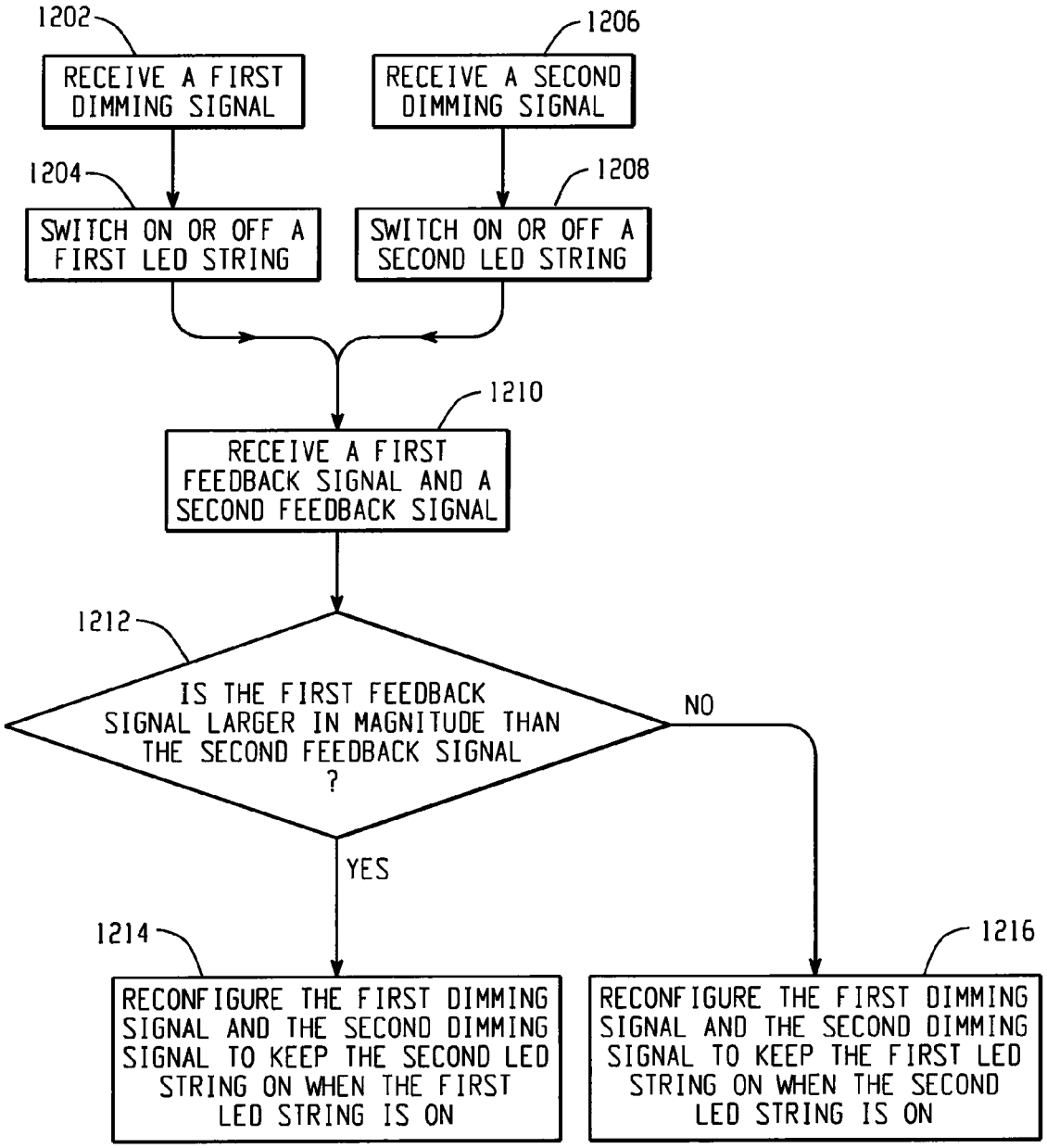
FIG. 12 illustrates another example flow diagram depicting a method for driving strings of LEDs.

FIG. 12 illustrates another example flow diagram depicting a method for driving strings of LEDs. A first dimming signal with a first dimming frequency is received at 1202. A first LED string is switched on or off in response to the first dimming signal at 1204. The first LED string has a first voltage drop when being switched on. At 1206, a second dimming signal with a second dimming frequency is received. A second LED string is switched on or off in response to the second dimming signal at 1208. The second LED string is coupled in parallel with the first LED string and having a second voltage drop when being switched on. A first feedback signal related to the first voltage drop and a second feedback signal related to the second voltage drop are received at 1210. It is determined whether the first feedback signal is larger than the second feedback signal in magnitude at 1212. If the first feedback signal is larger than the second feedback signal in magnitude, the first dimming signal and the second dimming signal are reconfigured to keep the second LED string on when the first LED string is on at 1214. If the first feedback signal is not larger than the second feedback signal in magnitude, the first dimming signal and the second dimming signal are reconfigured to keep the first LED string on when the second LED string is on at 1216.

This written description uses examples to disclose the invention, include the best mode, and also to enable a person skilled in the art to make and use the invention. The patentable scope of the invention may include other examples that occur to those skilled in the art. For example, systems and methods disclosed herein may be applied for different color displays, such as liquid crystal displays, light emitting diode displays, electroluminescent displays, plasma display panels, organic light emitting diode displays, surface-conduction electron-emitter displays, and nanocrystal displays. As an example, systems and methods can be configured as disclosed herein to enhance color saturation with much lower computational demand.

It is claimed:

1. A system for driving one or more light emitting diodes (LEDs) to reduce audible noise, the system comprising:

a first switching component configured to receive a dimming signal with a predetermined dimming frequency and configured to switch on or off the one or more LEDs in response to the dimming signal, the predetermined dimming frequency being higher than a frequency band of the audible noise;

a system controller configured to receive a feedback signal related to a LED current that flows through the one or more LEDs and configured to generate a drive signal; and a current generator configured to receive the drive signal, to generate a charging current to store energy during a charging period and to generate the LED current during a discharging period, the charging period and the discharge period being both within a dimming period corresponding to the predetermined dimming frequency, wherein the current generator includes a second switching component configured to receive the drive signal and switch on or off in response to the drive signal, the second switching component switching on during the charging period and switching off during the discharging period;

wherein the system controller further includes a current-limit detector configured to determine whether the charging current is larger than as limit in magnitude, and configured to output an over-current signal to switch off the second switching component when the charging current is larger than the limit in magnitude.

2. The system of claim 1, wherein the current generator further includes:

an inductive circuit coupled to the second switching component, the inductive circuit being configured to receive the charging current during the charging period and configured to generate the LED current during the discharging period.

3. The system of claim 2, wherein the current generator further includes:

a capacitive network configured to be charged during the discharging period and configured to discharge during the charging period.

4. The system of claim 1, wherein the system controller includes:

a comparator configured to receive the feedback signal and generate a comparison signal indicating whether the feedback signal is larger than a reference signal in magnitude; and a gate driver configured to receive the comparison signal and change the drive signal.

5. The system of claim 4, wherein the system controller further includes:

a signal generator configured to receive the dimming signal and generate an input signal, the gate driver being further configured to receive the input signal and change the drive signal to switch on the second switching component at least once during the dimming period.

6. The system of claim 1, the system controller further includes:

a current-limit-adjustment component configured to receive the feedback signal, to decrease the limit when the feedback signal is larger than an upper threshold in magnitude, and to increase the limit when the feedback signal is smaller than a lower threshold in magnitude.

7. The system of claim 1, further comprising:

a dimmer controller configured to generate the dimming signal, the dimming controller implementing a pulse-width-modulation scheme.

8. The system of claim 1, wherein a dimming period includes more than one charging period.

9. The system of claim 1, wherein a dimming period includes more than one discharging period.

10. A method for driving one or more light emitting diodes (LEDs) to reduce audible noise, the method comprising:

receiving a dimming signal with a predetermined dimming frequency;

switching on or off the one or more LEDs in response to the dimming signal, the predetermined dimming frequency being higher than a frequency band of the audible noise;

receiving a feedback signal related to a LED current that flows through the one or more LEDs;

generating a charging current to store energy during a charging period;

generating the LED current during a discharging period, the charging period and the discharge period being both within a dimming period corresponding to the predetermined dimming frequency; and switching off the charging current in response to detecting that the charging current is larger than a limit in magnitude.

* * * * *